US009099828B2

(12) United States Patent
Kaesser

(10) Patent No.: US 9,099,828 B2
(45) Date of Patent: Aug. 4, 2015

(54) MODULAR ELECTRICAL PLUG CONNECTOR ASSEMBLY

(75) Inventor: Rainer Kaesser, Althuette (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 13/985,489

(22) PCT Filed: Feb. 24, 2012

(86) PCT No.: PCT/EP2012/053198

§ 371 (c)(1),
(2), (4) Date: Oct. 24, 2013

(87) PCT Pub. No.: WO2012/130537

PCT Pub. Date: Oct. 4, 2012

(65) Prior Publication Data

US 2014/0045373 A1 Feb. 13, 2014

(30) Foreign Application Priority Data

Mar. 28, 2011 (DE) ..... 10 2011 006 195

(51) Int. Cl.

| | |
|---|---|
| ***H01R 13/514*** | (2006.01) |
| ***H01R 33/90*** | (2006.01) |
| ***H01R 13/504*** | (2006.01) |
| ***H01R 27/02*** | (2006.01) |
| ***H01R 43/26*** | (2006.01) |

(52) U.S. Cl.

CPC ..... *H01R 33/90* (2013.01); *H01R 13/504* (2013.01); *H01R 13/514* (2013.01); *H01R 27/02* (2013.01); *H01R 43/26* (2013.01); *H01R 2201/26* (2013.01); *Y10T 29/49208* (2015.01); *Y10T 29/49213* (2015.01)

(58) Field of Classification Search

CPC ..... H01R 13/6315; H01R 13/631; H01R 13/514; H01R 13/506; H01R 23/7073; H01R 23/7068

USPC ..... 439/247, 248, 79, 701

See application file for complete search history.

(56) References Cited

U.S. PATENT DOCUMENTS

| | | | | |
|---|---|---|---|---|
| 7,234,950 | B1 | 6/2007 | Wickett | |
| 8,303,315 | B2 * | 11/2012 | Lee | 439/79 |
| 2007/0000626 | A1 | 1/2007 | Stromberg et al. | |

FOREIGN PATENT DOCUMENTS

| | | | |
|---|---|---|---|
| CN | 1761108 | A | 4/2006 |
| FR | 2 827 083 | A1 | 1/2003 |

(Continued)

OTHER PUBLICATIONS

International Search Report for PCT/EP2012/053198, dated Apr. 20, 2012.

*Primary Examiner* — Gary Paumen
(74) *Attorney, Agent, or Firm* — Kenyon & Kenyon LLP

(57) ABSTRACT

A modular electrical plug connector assembly for control units in a motor vehicle includes a module rack and at least first and second plug-in modules that are situated in the module rack and that each includes respective housings shaped to accommodate respective electrical plug connectors. The housings are provided with respective electrically conductive contact elements. The first and second plug-in modules are positioned relative to one each other in a predetermined manner in the module rack, and are inseparably connected to the module rack by a joining process.

17 Claims, 3 Drawing Sheets

(56) References Cited

FOREIGN PATENT DOCUMENTS

| | | |
|---|---|---|
| JP | H 19961101 | 1/1996 |
| JP | H 08-287997 | 11/1996 |
| JP | H08287997 | 11/1996 |
| JP | H 09-187310 | 7/1997 |
| JP | 2000515298 | 11/2000 |
| JP | 2002517890 | 6/2002 |
| JP | 2009117218 | 5/2009 |
| JP | 2009543299 | 12/2009 |
| JP | 2010205724 | 9/2010 |
| WO | WO 2008/000103 | 1/2008 |
| WO | WO 2008/000931 A1 | 1/2008 |

* cited by examiner

MODULAR ELECTRICAL PLUG CONNECTOR ASSEMBLY

BACKGROUND

Various functions in motor vehicles today are regulated or controlled by control units. For example, the ignition, fuel injection times and also the electrical power windows or the electrical sunroof are controlled or regulated by such control units. In automotive engineering today, there is an observable trend toward concentrating on a few control units with which numerous functions may be controlled. This concentration on a few control units is associated with a greater number of electrical contacts with which more actuators are controlled or regulated, and also more parameters are detected by sensors. Furthermore, the number of sensors installed is increasing steadily and these in turn require additional electrical contacts on the control units. Control units manufactured in the 1990s had far fewer than 100 contacts, but today it is standard for a control unit to have slightly less than 200 contacts. Efforts are presently underway to furnish control units with approximately 300 contacts.

Already today multiple contacts are combined to form one plug-in module having a plug housing, so that one control unit includes multiple plug-in modules. Accordingly, multiple electrical connectors which are compatible with the plug-in modules or the plug housings and are connected to a wiring harness are also required for detecting the parameters supplied by the sensors and/or for triggering the actuators.

The plug-in modules which are integrated into the control unit and connect the control unit to the sensors and actuators are designed in a plug connector assembly in which the plug connector assembly, which includes the plug-in modules, is manufactured in one piece, monolithically, so to speak, by the plastic injection molding method.

The electrically conductive contacts connecting the printed circuits present in the control unit to the plug connectors of the wiring harnesses are designed as pin contacts made of metal. To manufacture the finished plug connector assembly, the pin contacts are inserted into the injection mold and are sheathed with plastic during the injection molding process. The pin contact protrudes approximately 8 mm out of the plastic surrounding it in the direction of the plug connector. The opposite side of the pin contact is usually bent at an angle for reasons of space and is contacted directly to the printed circuit. Each plug connector assembly is therefore manufactured in accordance with the layout of the printed circuits encompassed by the control units.

On the part of automobile manufacturers, there are strict requirements on the plug connector assembly to be met by the control unit manufacturers. The individual contacts which extend in the direction of the plug connector and are combined to form a plug-in module must provide a position tolerance of 0.4 mm at their contact tips. On the other side, there is an effort on the part of the control unit manufacturers who want to ensure that the contact tips of the contact elements facing the printed circuits are precisely positioned, so that there is no problem with the tips finding the receptacles provided for them on the printed circuits.

Unforeseeable warpage may occur with the plug connector assembly because of the large amount of metal due to the electrical contacts and the irregular distribution within the plug connector assembly as well as the associated possibility of differences in cooling of individual areas inside the plug connector assembly. To be able to meet the tolerances as stipulated above and nevertheless be able to manufacture the plug connector assemblies in a fully automated manner, extensive reworking on an injection molding tool is required after it has been manufactured, thus causing substantial costs.

SUMMARY

There may thus be a need for manufacturing such plug connector assemblies less expensively and with greater flexibility in making changes in plug-in modules.

According to an example embodiment of the present invention, a modular electrical plug connector assembly for control units in a motor vehicle includes a module rack and at least one first and second plug-in module, the first and second plug-in modules being situated side by side and/or in series in the module rack. The first plug-in module includes a first plug housing that is shaped to accommodate a first electrical plug connector. The second plug-in module includes a second plug housing that is shaped to accommodate a second electrical plug connector. The first plug housing includes an electrically conductive first contact element, and the second plug housing includes an electrically conductive second contact element. According to an example embodiment, the modular electrical plug connector assembly is structured for the first plug-in module and the second plug-in module to be positioned in a predetermined position relative to one another in the module rack. In addition, according to an example embodiment, the first and second plug-in modules are each inseparably connected to the module rack by a joining process.

The first and second plug connectors are designed to be complementary to the first and second plug housings and both are connected to a cable, whereby the plug connector includes an electrically conductive contact. The shape of one area of the contact element, provided for contacting with the contact of the plug connector, is complementary to that of the contact of the plug connector. Thus, an electrically conductive connection between the contacts and the contact elements is established by plugging the plug connector into the corresponding plug-in modules. The area of the contact element connected to the plug-in module can be designed as a male contact or as a female contact. It is also possible to include both male and female contacts in one plug-in module. Both the module rack and the plug-in modules are usually made of nonconductive plastic.

According to an example embodiment, the contact elements are introduced into the corresponding plug housing of the plug-in module during the plug housing manufacturing process. For example, according to an example embodiment, the contact elements are inserted into a plastic injection mold and are inseparably connected to the plug housing during the injection molding process. Alternatively, according to another example embodiment, the contact elements are introduced into the corresponding plug housing of the plug-in module and inseparably connected to it after the plug housing has already been manufactured, for example, by shooting the contact elements into the finished plug housing. After the first plug-in module and the second plug-in module or the first and second contact elements have been positioned in relation to one another, the plug-in modules are connected inseparably to the module rack by a joining process, for example by welding or gluing. The individual plug-in modules need not necessarily be situated in one plane; they may also be situated at a predetermined angle to one another.

In another example embodiment of the present invention, the module rack of the modular electrical plug connector assembly is delimited by a front side and a rear side opposite the front side, the module rack including a first passage for the first plug-in module, extending between the front side and the rear side in the direction from the front side to the rear side and a second passage for the second plug-in module, extending between the front side and the rear side in the direction from the front side to the rear side. The first passage is designed in such a way that the first plug-in module which is insertable into the first passage is displaceable across a first plug-in direction and is rotatable about a first axis extending in parallel to the first plug-in direction. The second passage is designed in such a way that the second plug-in module which is insertable into the second passage is displaceable across a second plug-in direction and is rotatable about a second axis extending in parallel to the second plug-in direction.

The plug-in module may be inserted into the module rack from the front side to the rear side of the module rack or from the rear side to the front side of the module rack. The heights of the respective plug-in modules, beyond the front side and beyond the rear side, can be respectively set as needed. The contact elements of the second plug-in module can be positioned accurately in relation to the contact elements of the first plug-in module due to the two or three translational degrees of freedom and the one rotational degree of freedom.

In another example embodiment of the present invention, the first plug housing of the modular electrical plug connector assembly includes first protrusions, these first protrusions being designed in such a way that the first plug-in module cannot be pushed through the first passage. In addition, the second plug housing includes second protrusions, these second protrusions being designed in such a way that the second plug-in module cannot be pushed through the second passage.

The plug-in modules may thus be inserted so far into their corresponding passages that the protrusions belonging to the corresponding housing are in contact with the front side or the rear side of the module rack. The front side or rear side of the module rack in combination with the protrusions thus determine the plane in which the individual plug-in modules are positioned.

In another example embodiment of the present invention, the first protrusions are connected to form a first flange, the first flange being designed in such a way that the first passage is covered by the first flange. The second protrusions are connected to form a second flange, the second flange being designed in such a way that the second passage is covered by the second flange.

This ensures that, regardless of the position of the plug-in module, the flange will reliably cover the corresponding passage. Thus the flange can at the same time also function as the adhesive surface for connecting the plug-in module to the module rack with the aid of a suitable adhesive. The flange can also be inseparably connected to the module rack at the periphery by welding. The adhesive connection as well as the welded connection ensures that the plug-in module is connected to the module rack in a dustproof, splash water-protected and possibly also waterproof and vibration-proof manner.

In another example embodiment of the present invention, a seal is inserted between the first and/or second flange and the module rack.

In another example embodiment of the present invention, the first plug-in module includes first locking elements which are situated on the first plug housing and are inseparably connected to the first plug housing for locking the first plug connector. The second plug-in module includes second locking elements which are situated on the second plug housing and are inseparably connected to the second plug housing for locking the second plug connector.

The plug connectors are locked in this position to the corresponding plug housing with the aid of the locking elements after attachment to the plug-in module. The locking here is designed to be unlockable. The locking ensures that the plug connector may be connected to the plug-in module in a vibration-proof manner. In the case of plug connectors including a small number of contacts in particular, it is possible to omit locking if the holding forces of the contact elements of the plug-in module, which are designed to be complementary to one another, and the contacts of the plug connector are strong enough so that the plug connector is not able to be detached from the plug-in module due to vibrations.

In another example embodiment of the present invention, the first contact element and the second contact element each includes a respective first subelement. The first subelement of the first contact element extends beyond the first plug housing. The first subelement of the second contact element extends beyond the second plug housing. The first subelement of the first contact element and the first subelement of the second contact element are positioned in relation to one another.

The first subelement can also extend in the plug-in direction of the corresponding plug-in module into the module rack as well as against the plug-in direction. The first subelement can also extend across the plug-in direction. The first subelement of the first contact element and the first subelement of the second contact element also need not necessarily extend in the same direction.

The contact elements situated inside the plug-in module are generally positioned accurately in relation to one another due to the manufacturing process of the individual plug-in module. The first subelements will generally extend against the plug-in direction of the plug-in modules, the first subelements being configured to be connected in an electrically conductive manner to the printed circuit of the control unit. There is also a positioning of the individual plug-in modules in relation to one another through a positioning based on the first subelements. Through the accurate positioning of the first subelements of all plug-in modules in relation to one another, it is possible for an electrically conductive connection of the contact elements to the at least one printed circuit of the control unit to be established with no problem even when there is fully automated manufacturing. The accurate positioning may be created, for example, in that the areas of all subelements of the individual plug-in modules, which are accommodated by the at least one printed circuit of the control unit, are provided with a position tolerance of 0.4 mm in relation to one another. These areas may be accommodated, for example, through openings, such as, for example, boreholes in the at least one printed circuit, these areas being connected to the printed circuit in an electrically conductive manner, for example, by soldering after being inserted into the openings.

In another example embodiment of the present invention, the first contact element of the modular electrical plug connection and the second contact element each includes one respective second subelement, the second subelements being situated at an angle to the first subelements, the respective first and second subelements being connected to one another in an electrically conductive manner.

The second subelements are generally connected directly to the printed circuits. The connection may be a soldered connection. The second subelements may also be pressed into the printed circuit. There is also the possibility of connecting the second subelements to plug connectors situated on the printed circuits. Since, for reasons of space, the plug-in modules are generally situated in such a way that the plug-in direction is in parallel to the direction of extension of the circuit board assembled with electrical components, the second subelements generally form a 90° angle to the first subelements, but they may also form any other angle. Depending on the design of the contact points of the printed circuits, the first and/or second subelements may also be designed to be of different lengths within a plug-in module.

In another example embodiment of the present invention, at least one contact element from the group of the first contact element and the second contact element is formed as an electrically conductive pin.

Electrically conductive contacts in pin form may be manufactured in a particularly inexpensive manner. The contacts may be manufactured in one piece. Such pins may include a circular, square or rectangular cross section, for example. The cross-sectional area may be determined on the basis of the electrical currents to be transmitted. The cross-sectional areas for triggering actuators, for example, of the ignition, are generally designed to be larger than the cross-sectional areas for the test of sensors.

In another example embodiment of the present invention, the first plug-in module is different from the second plug-in module. For example, according to an example embodiment, the number of contact elements within the first plug-in module is different than the number of contact elements of the second plug-in module. According to an example embodiment, the plug housings of the particular plug-in modules are also designed differently.

In another example embodiment of the present invention, a control unit for a motor vehicle is equipped with a modular electrical plug connector assembly.

Some advantages of the present invention include the following. The modular configuration of the electrical plug connector assembly with the aid of a module rack and plug-in modules provides the possibility of an inexpensive and space-saving integration of the plug-in modules. The shape of the plug-in modules can be designed individually. In addition, the plug-in modules can be situated individually. The warpage and shrinkage problems mentioned at the outset, which are the result of using plastic with regard to shape and load tolerances, have largely no effect, thereby reducing or completely eliminating any tool correction costs with regard to the plug-in module position tolerances. A layout of the contact elements which ensure transmission of signals from the interior of the control unit or from the printed circuits to the plug connectors and the cables connected to them on the outside offers a new freedom of design. In addition, the injection molding tools may have a simpler design and may thus be less expensive. Due to the fact that the plug-in modules are manufactured individually, they can be manufactured with a higher precision and allow the plug forces for the plug connectors to remain within narrower limits. In addition, the modular configuration permits a greater freedom in the design of plug connectors connected to a cable.

Example embodiments of the present invention are described herein in conjunction with a modular electrical plug connector assembly including a module rack and plug-in modules as well as with a control unit. It will be clear to those skilled in the art that the individual features described herein can be combined in various ways to arrive at different embodiments of the present invention.

Specific example embodiments of the present invention are described below with reference to the accompanying figures. The figures are only schematic and are not drawn to scale.

DETAILED DESCRIPTION

Figure 1:
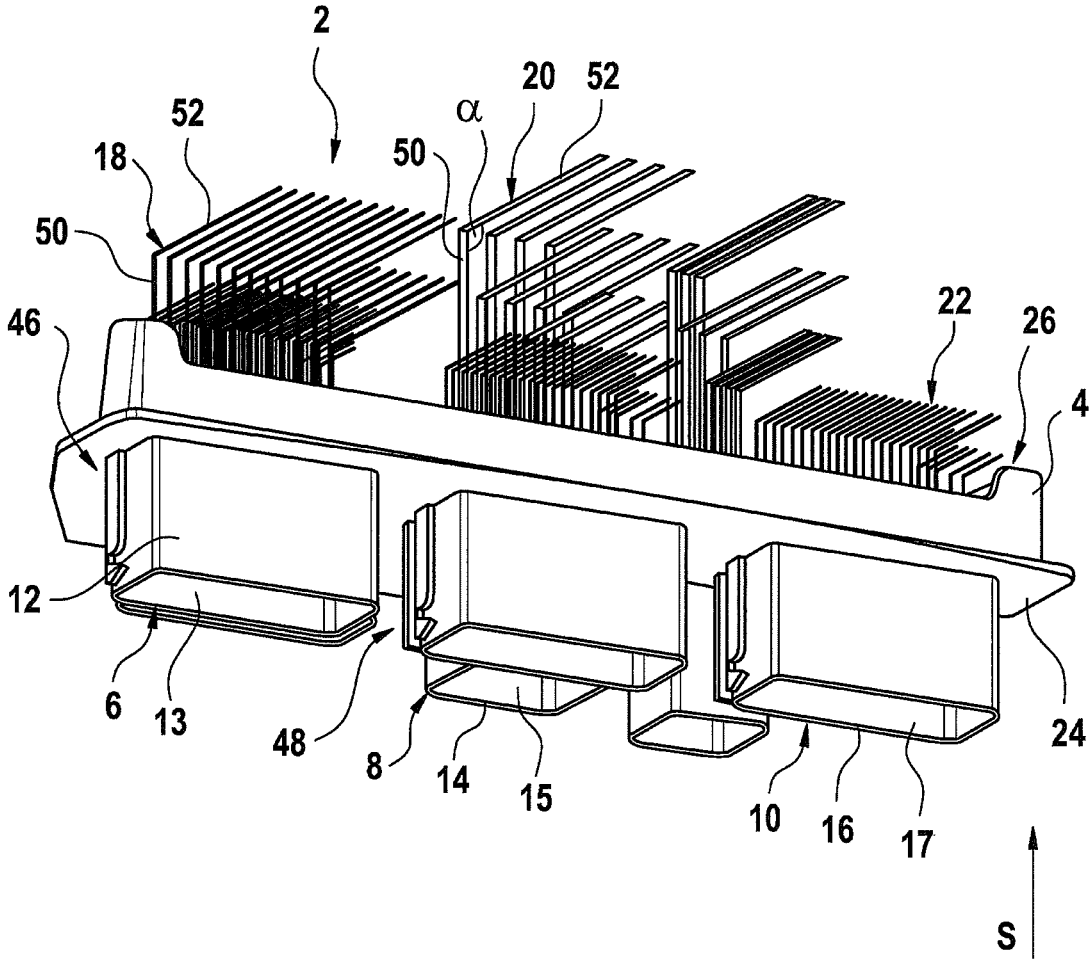
FIG. 1 shows a modular electrical plug connector assembly including a module rack and plug-in modules in a perspective view, according to an example embodiment of the present invention.

FIG. 1 shows a perspective view of a modular electrical plug connector assembly 2 including a module rack 4, a first plug-in module 6, a second plug-in module 8, and a third plug-in module 10. First plug-in module 6, second plug-in module 8, and third plug-in module 10 are situated either side by side or in series. First plug-in module 6 includes a first plug housing 12, second plug-in module 8 includes a second plug housing 14, and third plug-in module 10 includes a third plug housing 16. All plug housings 12, 14, 16 are shaped to accommodate one electrical plug connector (not shown here) in a plug-in direction S marked with an arrow. In addition, a first contact element 18 is situated in first plug-in module 6, a second contact element 20 is situated in second plug-in module 8, and a third contact element 22 is situated in third plug-in module 10. Contact elements 18, 20, and 22 are designed to be electrically conductive. All contact elements 18, 20, and 22 extend in plug-in direction S beyond corresponding plug housing 12, 14, and 16. Plug-in modules 6, 8, and 10 are situated in module rack 4, in such a way that corresponding plug housings 12, 14, and 16 extend from a front side 24 of module rack 4 against plug-in direction S. A rear side 26 opposite front side 24 of module rack 4 faces an interior of a control unit (not shown here). All contact elements 18, 20, and 22 are designed as one-piece pin contacts in the example embodiment described here. The portion beyond plug housing 12, 14, and 16 with respect to plug-in direction S is divided into a first subelement 50 and a second subelement 52. First subelement 50 extends in plug-in direction S. Second subelement 52 is at an angle to the first subelement, first subelement 50 and second subelement 52 forming an angle $\alpha$. In the illustrated example embodiment, the angle $\alpha$ is 90°. First subelement 50 and second subelement 52 may also be of different lengths within a plug-in module 6, 8, 10. The at least one second subelement 52 is provided for being accommodated in and/or on a printed circuit (not shown here). In the present example embodiment, the at least one second subelement 52 is shaped for insertion into boreholes in a circuit board of the printed circuit and soldered there. Second subelements 52 are aligned in parallel to one another and extend all in the same direction. Second subelements 52 are positioned in relation to one another in such a way that the position tolerance at all ends provided for soldering to the circuit board is 0.4 mm. In addition, the position tolerance of second subelements 52 to rear side 26 of module rack 4 may also be 0.4 mm.

First plug housing 12 delimits a first interior space 13, second plug housing 14 delimits a second interior space 15, and third plug housing 16 delimits a third interior space 17. Third subelements 54 (shown in FIG. 2 with respect to plug-in module 6), designed as pins, protrude approximately 8 mm into interior spaces 13, 15, and 17 of plug housings 12, 14, and 16. First locking element 46 and second locking element 48 are formed on the narrow sides of plug-in modules 6, 8, and 10. Locking elements 46 and 48 lock the plug connectors inserted into plug housings 12, 14, and 16 (not shown here).

To remove the plug connectors from plug housings 12, 14, and 16, locking elements 46 are 48 are unlockable, the release mechanism mostly being formed on the plug connectors. Locking elements 46 and 48 prevent the plug connectors from being unlockable automatically from plug-in modules 6, 8, and 10 due to vibrations, for example. Plug-in modules 6, 8, and 10 are inseparably connected to module rack 4.

Figure 2:
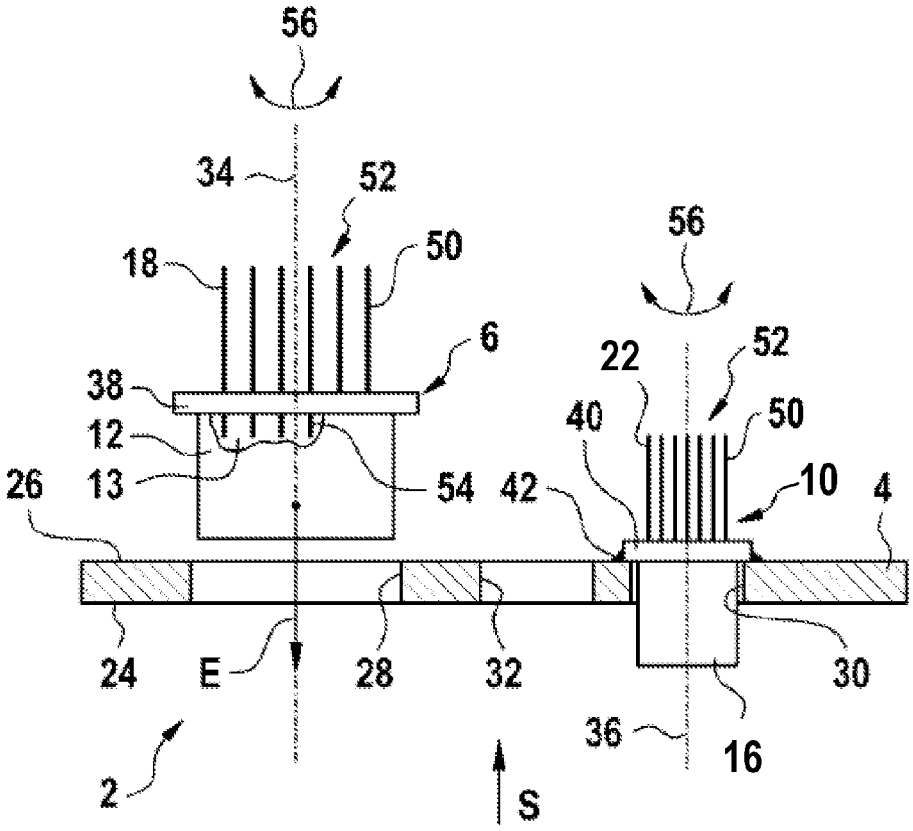
FIG. 2 shows a cross section of the module rack including two plug-in modules, according to an example embodiment of the present invention.

FIG. 2 shows a cross section through module rack 4 including first plug-in module 6 and third plug-in module 10, according to an example embodiment of the present invention. A first passage 28, a second passage 30 and a third passage 32 are formed in module rack 4. First passage 28 is designed to accommodate first plug-in module 6, second passage 30 is designed to accommodate third plug-in module 10, and third passage 32 is designed to accommodate second plug-in module 8 (not shown here). Passages 28, 30, and 32 extend between front side 24 and rear side 26 of module rack 4 in the direction from front side 24 to rear side 26. It is clearly apparent that first plug-in module 6 is different from third plug-in module 10. In the present example embodiment, first plug-in module 6 and third plug-in module 10 are inserted from rear side 26 of module rack 4 along a plug-in direction E to front side 24 of module rack 4. Plug-in direction E extends in parallel to passages 28, 30, and 32. Plug-in direction E of plug-in modules 6 and 10 is against plug-in direction S of the plug connectors (not shown here). It is clearly apparent that passages 28 and 30 are larger than corresponding plug-in modules 6 and 10. Plug-in modules 6 and 10 here may be displaced across plug-in direction E for more accurate positioning. In addition, a first axis 34 extends in parallel to plug-in direction E, about which first plug-in module 6 is rotatable at a predetermined angle. A second axis 36 also extends in parallel to plug-in direction E about which third plug-in module 10 is also rotatable at a predetermined angle. The rotatability of plug-in modules 6 and 10 is indicated by curved double arrows 56. To prevent plug-in modules 6 and 10 from being insertable through passages 28 and 30, respectively, first plug housing 12 includes a first peripheral flange 38 and third plug housing 16 includes a second peripheral flange 40. According to an example embodiment, the flanges 38 and 40 are designed like disks, and in such a way that they cover passages 28 and 30, regardless of the position within passages 28 and 30 assumed by plug-in modules 6 and 10.

Plug-in modules 6 and 10 are positioned by the fact that first subelements 50 protruding beyond plug housings 12 and 16 are set at a predetermined distance from one another. In this condition, individually manufactured plug-in modules 6 and 10 are inseparably connected to module rack 4, which is designed in one piece with the aid of a joining process. In the example embodiment shown here, third plug-in module 10 has been welded to module rack 4, the weld seam being represented by a welding bead 42. The peripheral weld seams ensure that plug-in modules 6 and 10 are connected to module rack 4 in such a way that neither dust nor splashed water is able to migrate between (a) plug-in modules 6 and 10 and (b) passages 28 and 30 from front side 24 to rear side 26 and thus possibly be able to penetrate into an interior unit at rear side 26.

Figure 3:
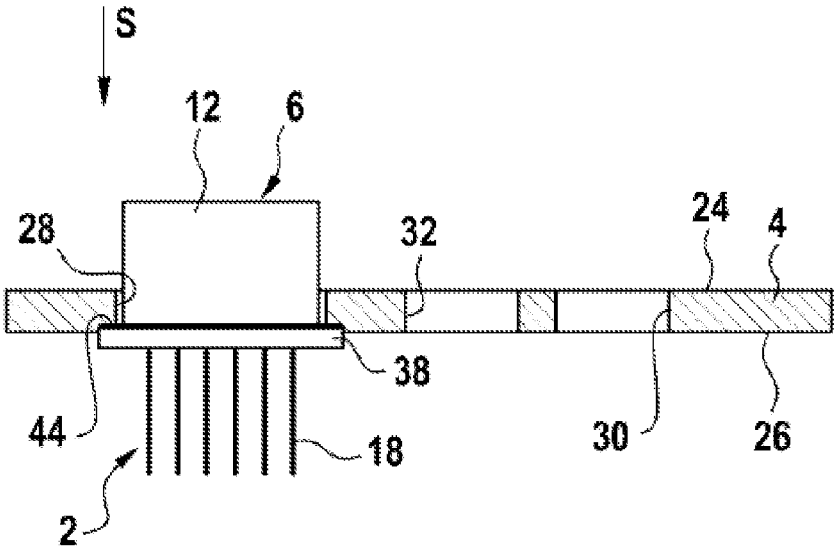
FIG. 3 shows a cross section of the module rack including one plug-in module and a seal, according to an example embodiment of the present invention.

FIG. 3 shows a cross section through module rack 4 including first plug-in module 6, according to an example embodiment of the present invention. In this example embodiment, a seal 44 covering first passage 28 is situated between first flange 38 and rear side 26 of module rack 4.

Figure 4:
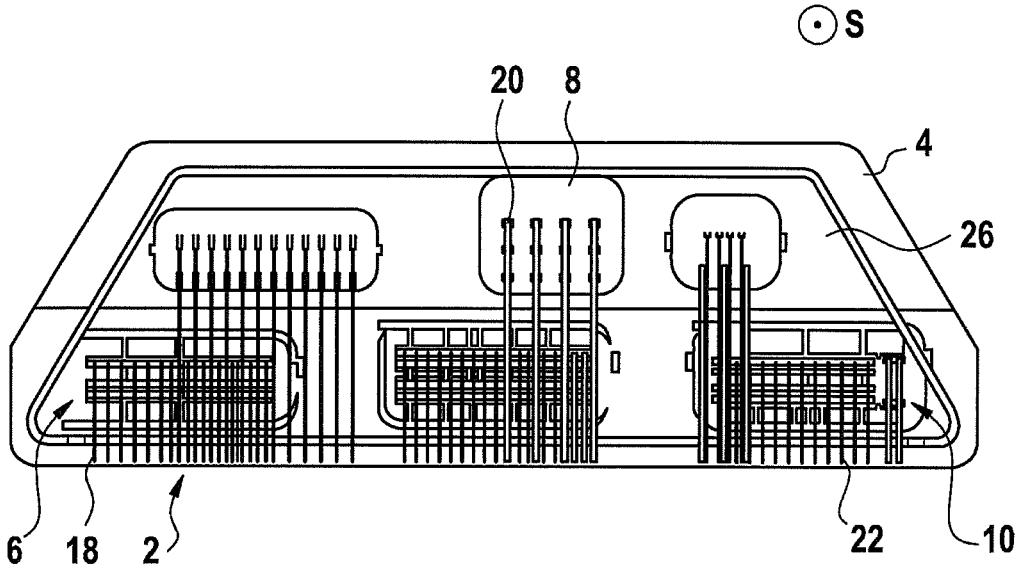
FIG. 4 shows a rear side of the module rack assembled with plug-in modules in a top view, according to an example embodiment of the present invention.

FIG. 4 shows rear side 26 of module rack 4 including plug-in modules 6, 8 and 10 in a top view. Rear side 26 faces the printed circuit (not shown here). Contact elements 18, 20, and 22 of corresponding plug-in modules 6, 8 and 10 are shown to be of different thicknesses. This is also continued in a cross-sectional area of individual contact elements 18, 20 and 22, so that a cross-sectional area of second contact element 20 is larger than a cross-sectional area of first contact element 18, for example. Thus, second contact element 20 is able to transmit higher currents than first contact element 18, for example to control or regulate actuators such as, for example, the ignition or the fuel injection, while, for example, parameters detected by sensors are transmitted with the aid of contact elements 18 and 22 including the smaller cross section(s). In the example embodiment shown here, all second subelements 52 end at the same height. All contact elements 18, 20, and 22 of corresponding plug-in modules 6, 8, and 10 are electrically conductively connected to the printed circuit. The electrical conductivity in the example shown here is ensured, for example, by a soldering process. For this purpose, the second subelements are therefore inserted into boreholes located in a circuit board of the printed circuit.

What is claimed is:

1. A modular electrical plug connector assembly for control units in a motor vehicle, the assembly comprising:

a module rack;

a first plug-in module situated in, and inseparably connected to, the module rack and including a first plug housing, wherein the first plug housing (a) is configured for accommodating a first electrical plug connector and (b) includes an electrically conductive first contact element; and a second plug-in module situated in, and inseparably connected to, the module rack and including a second plug housing, wherein the second plug housing (a) is configured for accommodating a second electrical plug connector and (b) includes an electrically conductive second contact element;

wherein the first contact element and the second contact element each includes a first subelement, the first subelement of the first contact element extends beyond the first plug housing and the first subelement of the second contact element extends beyond the second plug housing; and wherein the first contact element and the second contact element each includes a second subelement, the second subelements being situated at an angle to, and electrically conductively connected to, the first subelements.

2. The modular electrical plug connector assembly of claim 1, wherein:

the first plug-in module is inserted in a first passage that (a) extends between a front side and a rear side of the module rack, and (b) is shaped to allow for (i) displacement of the first plug-in module in the first passage in a plug-in direction in which the first plug-in module is inserted into the first passage and (ii) rotation of the first plug-in module, within the first passage, about an axis that extends parallel to the plug-in direction in which the first plug-in module is inserted into the first passage; and the second plug-in module is inserted in a second passage that (a) extends between the front side and the rear side of the module rack, and (b) is shaped to allow for (i) displacement of the second plug-in module in the second passage in a plug-in direction in which the second plug-in module is inserted into the second passage and (ii) rotation of the second plug-in module, within the second passage, about an axis that extends parallel to the plug-in direction in which the second plug-in module is inserted into the first passage.

3. The modular electrical plug connector assembly of claim 1, wherein at least one of:

the first plug housing includes a first protrusion that prevents the first plug-in module to be inserted completely through the first passage; and the second plug housing includes a second protrusion that prevents the second plug-in module to be inserted completely through the second passage.

4. The modular electrical plug connector assembly of claim 3, wherein at least one of:

the first protrusion is formed as a first flange that covers a perimeter of the first passage; and the second protrusion is formed as a second flange that covers a perimeter of the second passage.

5. The modular electrical plug connector assembly of claim 1, wherein at least one of:

a first locking element is situated on, and inseparably connected to, the first plug housing for locking the first electrical plug connector; and a second locking element is situated on, and inseparably connected to, the second plug housing for locking the second electrical plug connector.

6. The modular electrical plug connector assembly of claim 1, wherein at least one of the first and second contact elements includes an electrically conductive pin.

7. The modular electrical plug connector assembly of claim 1, wherein the first plug-in module is different from the second plug-in module.

8. The modular electrical plug connector assembly of claim 1, wherein the first and second plug-in modules are situated side by side in the module rack.

9. A control unit for a motor vehicle, the control unit comprising:

a modular electrical plug connector assembly that includes:

a module rack;

a first plug-in module situated in, and inseparably connected to, the module rack and including a first plug housing, wherein the first plug housing (a) is configured for accommodating a first electrical plug connector and (b) includes an electrically conductive first contact element; and a second plug-in module situated in, and inseparably connected to, the module rack and including a second plug housing, wherein the second plug housing (a) is configured for accommodating a second electrical plug connector and (b) includes an electrically conductive second contact element;

wherein the first contact element and the second contact element each includes a first subelement, the first subelement of the first contact element extends beyond the first plug housing and the first subelement of the second contact element extends beyond the second plug housing; and wherein the first contact element and the second contact element each includes a second subelement, the second subelements being situated at an angle to, and electrically conductively connected to, the first subelements.

10. A method for manufacturing a modular electrical plug connector assembly for control units in a motor vehicle, the assembly including (I) a module rack, (II) a first plug-in module that includes a first plug housing, the first plug housing (a) being configured for accommodating a first electrical plug connector and (b) including an electrically conductive first contact element; and (III) a second plug-in module that includes a second plug housing, the second plug housing (a) being configured for accommodating a second electrical plug connector and (b) including an electrically conductive second contact element, the method comprising:

inserting the first and second plug-in modules into the module rack; and inseparably connecting the first and second plug-in modules to the module rack with a joining process;

wherein the first contact element and the second contact element each includes a first subelement, the first subelement of the first contact element extends beyond the first plug housing and the first subelement of the second contact element extends beyond the second plug housing; and wherein the first contact element and the second contact element each includes a second subelement, the second subelements being situated at an angle to, and electrically conductively connected to, the first subelements.

11. The method of claim 10, further comprising, subsequent to the inserting, adjusting the positions of the first and second plug-in modules relative to each other.

12. The method of claim 11, wherein the inserting includes inserting the first and second plug-in modules into respective passages that each extends between a front side and a rear side of the module rack.

13. The method of claim 12, wherein the adjusting includes adjusting at least one of the first and second plug-in modules rotationally about an axis that is parallel to a direction of the inserting.

14. The method of claim 10, wherein the inserting includes inserting the first and second plug-in modules into respective passages that each extends between a front side and a rear side of the module rack.

15. The method of claim 14, further comprising, subsequent to the inserting, adjusting the positions of the first and second plug-in modules linearly in a direction that is perpendicular to a direction of the inserting.

16. The method of claim 14, further comprising, subsequent to the inserting, adjusting the positions of the first and second plug-in modules linearly in a direction that is parallel to a direction of the inserting.

17. The method of claim 10, wherein the joining process includes soldering respective flanges of the first and second plug-in modules to the module rack.

* * * * *